United States Patent [19]

Crosier

[11] Patent Number: 5,073,987

[45] Date of Patent: Dec. 24, 1991

[54] TIE WITH PICTURE POCKET

[76] Inventor: Glenn W. Crosier, 2403 Lillian St., Apt. 11A, Omaha, Nebr. 68147

[21] Appl. No.: 715,450

[22] Filed: Jun. 14, 1991

[51] Int. Cl.[5] ..... A41D 25/00

[52] U.S. Cl. ..... 2/144; 2/247; 2/246; 2/244; 40/1; 40/152; 40/156; 40/159

[58] Field of Search ..... 2/144, 246, 247, 250, 2/102, 146; 40/152, 156, 159, 1, 1.5, 625, 626, 642

[56] References Cited

U.S. PATENT DOCUMENTS

| | | | |
|---|---|---|---|
| 159,112 | 1/1875 | Mueller | 2/144 |
| D. 264,892 | 6/1982 | Stewart, Jr. et al. | D2/343 |
| 1,550,134 | 9/1921 | Whitney | 2/144 |
| 2,630,574 | 3/1949 | Malarkey | 2/144 |
| 2,918,678 | 3/1958 | Gouner | 2/144 |
| 2,986,743 | 6/1961 | Eilen | 2/247 |
| 3,055,133 | 3/1960 | Anderson | 40/129 |
| 3,206,765 | 2/1964 | Sherman | 2/144 |
| 4,924,613 | 5/1990 | Levin | 40/586 |

*Primary Examiner*—Werner H. Schroeder
*Assistant Examiner*—Gloria Hale
*Attorney, Agent, or Firm*—Zarley, McKee, Thomte, Voorhees & Sease

[57] ABSTRACT

A necktie is formed with an elongated front flap of a flattened tubular fabric material having a forward layer and a rearward layer with a cavity therebetween. A rear flap of fabric material is connected at the upper end to the upper end of the front flap to form an elongated tie. A fabric sheet is mounted in the cavity in the front flap with the upper end of the fabric sheet attached to the rearward layer and the lower end of the fabric sheet folded upwardly and connected to the rearward surface of the forward layer so as to form to a generally J-shaped configuration. A transverse slot is formed in the rearward layer above the fabric sheet to permit the insertion of a photograph into the cavity. An opening is formed in the forward layer immediately forward of the fabric sheet and located above the lower end of the fabric sheet so as to reveal the photograph inserted within the cavity. A second slot is formed above the first slot in the rearward layer such that the rear flap of the tie may be inserted through the second and then the first slots so as to lock the photograph in position within the cavity.

7 Claims, 1 Drawing Sheet

TIE WITH PICTURE POCKET

TECHNICAL FIELD

The present invention relates generally to neckties, and more particularly to an improved necktie having a pocket for the display of a picture.

BACKGROUND OF THE INVENTION

Neckties have been worn by men for ornamentation for many years. During this time, many different types of accessories have been created for use with the tie to further ornament the tie. For example, tie clips have been created in many different forms and constructed of many different materials in order to create an anesthetic appearance.

Ties have been formed of materials having different patterns thereon to provide ornamentation. In fact, ties have been provided with three dimensional objects thereon, such as the invention described in U.S. Pat. No. 2,630,574 to G. E. Malarkey. U.S. Pat. No. 2,918,678 to A. L. Gouner discloses necktie ornamentation which provides one or more ribbons which overlay the front face of a necktie. In 1875, Andrew Mueller was granted a patent for a scarf having a sliding front piece which could be depressed to expose a photograph.

It is therefore a general object of the present invention to provide a novel tie having a pocket formed in the front panel thereof for the display of a photograph.

Another object of the present invention is to provide an ornamented necktie wherein a photograph appears through the front face of the necktie, but is firmly held in place by a pocket accessible from the rear of the tie material.

Another object is to provide an improved ornamented necktie with a pocket for a photograph having means for locking the photograph in position.

Yet another further object is to provide a necktie with a picture pocket which is refined in appearance.

SUMMARY OF THE INVENTION

The necktie of the present invention is formed with an elongated front flap of a flattened tubular fabric material having a forward layer and a rearward layer with a cavity therebetween. A rear flap of fabric material is connected at the upper end to the upper end of the front flap to form an elongated tie. A fabric sheet is mounted in the cavity in the front flap with the upper end of the fabric sheet attached to the rearward layer and the lower end of the fabric sheet folded upwardly and connected to the rearward surface of the forward layer so as to form to a generally J-shaped configuration. A transverse slot is formed in the rearward layer above the fabric sheet to permit the insertion of a photograph into the cavity which is supported by the fabric sheet. An opening is formed in the forward layer immediately forward of the fabric sheet and located above the lower end of the fabric sheet so as to reveal the photograph inserted within the cavity. A second slot is formed above the first slot in the rearward layer such that the rear flap of the tie may be inserted through the second and thence the first slots so as to lock the photograph in position within the cavity.

DESCRIPTION OF THE PREFERRED EMBODIMENTS

Figures 1, 2, 3, 4, 5:
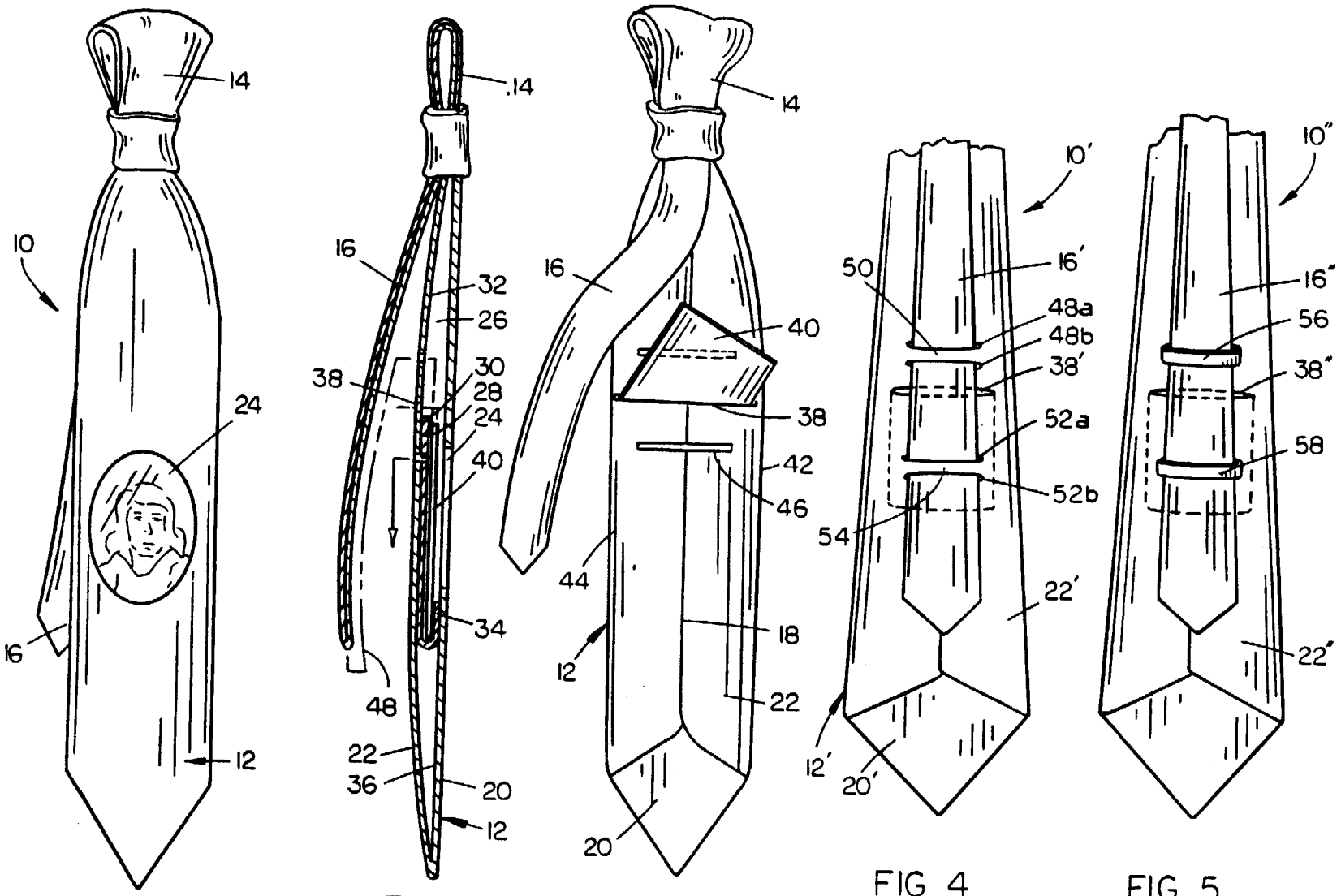
FIG. 1 is a front elevational view of the tie of the present invention.
FIG. 2 is a vertical sectional view through the length of the tie.
FIG. 3 is a rear perspective view of the present invention with a photograph shown being inserted in a pocket therein.
FIG. 4 is a rear view of a second embodiment of the invention.
FIG. 5 is a rear view of a third embodiment of the invention.

Referring now to the drawings, in which similar or corresponding parts are identified with the same reference numeral, and more particularly to FIG. 1, the necktie of the present invention is designated generally at 10 and includes a front flap 12, a knot 14 and a rear flap 16.

As shown on FIG. 3, front flap 12 is formed of a decorative fabric formed into an elongated flattened tube with a seam 18 along the center of the tube on the inner side thereof. For ease of description, the flattened tube of front flap 12 will be described as having a forward layer 20 and a rearward layer 22, the rearward layer having seam 18 along its vertical length. In most cases, a fabric lining (not shown) is placed within the front flap 12 and rear flap 16. Referring now to FIG. 2, forward layer 20 has an opening 24 formed therethrough to permit viewing of the interior cavity 26 of front flap 12. A short piece of fabric 28 is attached along its upper edge 30 to the forward surface 32 of rearward layer 22, and extends downwardly adjacent rearward layer 32. The lower edge 34 of fabric sheet 28 is folded upwardly and attached to the rearward surface 36 of forward layer 20 to such that fabric sheet 28 forms a general "J-shaped" configuration. A slot 38 is cut through the width of rearward layer 22 immediately above the attachment of upper edge 30 of fabric sheet 28 to rearward layer 22, to permit the insertion of a photograph 40 into interior cavity 26 of front flap 12. It can be seen that the "J-shaped" sheet of fabric 28 will retain photograph 40 positioned directly behind opening 24 in forward layer 20. Preferably, photograph 40 has a width similar to the width of front flap 12, such that the side edges 42 and 44 of front flap 12 will retain the photograph 40 in aligned lateral position with opening 24. Obviously, side members could be added to fabric sheet 28 to retain the lateral position of a photograph, if a photograph smaller than the width of front flap 12 is utilized.

A lower slot **46*a* is formed through rearward layer 22 and fabric sheet 28 spaced slightly below first slot 38 and preferably having a width less than slot 38, to receive rear flap 16 therethrough. An upper slot 46*b* is also formed through rearward layer 22 and spaced slightly above slot 38 and preferably having a width less than slot 38, to receive rear flap 16 therethrough. As shown by arrow 48 in FIG. 2, rear flap is threaded through upper slot 46*b* into cavity 26, and thence through lower slot 46*a* so as to retain rear flap 16 in position as well as locking photograph 40 within the pocket formed by the "J-shaped" sheet 28 in front flap 12**.

Referring now to FIG. 4, a second embodiment of the invention is designated generally at 10', and includes a tie front flap 12 comprised of a forward layer 20' and rearward layer 22, Necktie 10, has a rearward flap 16' and a slot 38, similar to the first embodiment. However, in the second embodiment of tie 10', a pair of upper slots **48*a* and 48*b* are formed in rearward layer 22, so as to form a narrow strip 50 which will retain rear flap 16, in position when threaded through slots 48*a* and 48*b*. A second pair of slots 52*a* and 52*b* are formed in rearward layer 22' below slot 38' so as to form a narrow strip 54. As shown in FIG. 4, rear flap 16, is threaded through slots 48*a* and 48*b* and thence slots 52*a* and 52*b* so as to lock a picture within slot 38'. In a third embodiment of the invention, designated generally at 10'' in FIG. 5, a narrow strip of material is formed into a loop 56 and fastened slightly above slot 38,, A second loop 58 is fastened below slot 38'', such that rearward flap 16'' may be journaled through loops 56 and 58 to retain a picture within slot 38''**.

Whereas the invention has been shown and described in connection with a preferred embodiment thereof, it will be understood that many modifications, substitutions and additions may be made which are within the intended broad scope of the appended claims. For example, necktie 10 may be a single elongated length of material, or a pre-formed necktie with a knot 14 already formed therein. Likewise, the opening 24 in front flap 12 may be of any aesthetic shape, such as oval, circular, or the like.

Thus, there has been shown and described an improved tie with a picture pocket designed to permit locking of the photograph within the pocket utilizing the rear flap of a necktie, which accomplishes at least all of the above stated objects

I claim:

1. A necktie, comprising, an elongated front flap having upper and lower ends, formed of a flattened tubular fabric material to form a forward layer and a rearward layer with a cavity therebetween, said forward and rearward layers each having forward and rearward surfaces;

a rear flap of fabric material connected at an upper end to the upper end of the front flap;

a fabric sheet having an upper and lower end, attached at its upper end to the forward surface of said rearward layer and depending therefrom;

said fabric sheet lower end folded upwardly and connected to the rearward surface of said forward layer to form a generally "J-shaped" configuration in the cavity between said forward and rearward layers of said front flap;

a generally transverse first slot formed in said rearward layer above the upper end of said fabric sheet, for the insertion of a photograph into said cavity; and an opening formed in said forward layer immediately forward of said fabric sheet, and located above the lower end of said fabric sheet, to reveal a photograph inserted within said first flap cavity.

2. The necktie of claim 1, further comprising a second slot formed in said rearward layer and said fabric sheet, parallel to and spaced vertically below the first slot, of a size to receive the rear flap therethrough.

3. The necktie of claim 2, further comprising a photograph inserted within said cavity, and wherein said rear flap is inserted through said first slot and thence through said second slot to lock said photograph in position within said cavity.

4. The necktie of claim 2, further comprising a third slot formed in said rearward layer, parallel to and spaced vertically above the first slot, of a size to receive the rear flap therethrough.

5. The necktie of claim 4, further comprising a photograph inserted within said cavity, and wherein said rear flap is inserted through said third slot, thence through a portion of the cavity and thence outwardly through said second slot to lock said photograph in position within said cavity by covering said first slot.

6. The necktie of claim 1, further comprising means on the rearward layer of said front flap for retaining said rear flap in a position covering said first slot, to lock a photograph within said cavity.

7. The necktie of claim 6, wherein said means for retaining said rear flap includes:

a first loop of material for receiving said rear flap therethrough, fastened above said first slot; and a second loop of material for receiving said rear flap therethrough, fastened below said first slot.

* * * * *